US005967093A

United States Patent [19]

Vitt et al.

[11] Patent Number: 5,967,093

[45] Date of Patent: Oct. 19, 1999

[54] EQUESTRIAN JUMP AND BRACKET FOR CREATING AN ANGULAR OBSTACLE

[75] Inventors: Timothy Alan Vitt; Robert Todd Lewis, both of Medford Lakes, N.J.

[73] Assignee: Topline Equine, Inc., Medford Lakes, N.J.

[21] Appl. No.: 08/944,999

[22] Filed: Oct. 7, 1997

[51] Int. Cl.[6] ..... A63K 3/04

[52] U.S. Cl. ..... 119/705; 472/86; 482/16; 482/17; 482/38

[58] Field of Search ..... 482/15–17, 38, 482/41, 42; 119/705; 472/85–87; 248/219.1, 219.2, 219.3, 219.4, 220.1, 218.4; 256/60, 64, 65, 67, 72

[56] References Cited

U.S. PATENT DOCUMENTS

| | | | |
|---|---|---|---|
| 5,334,119 | 8/1994 | Eloranta | 482/16 |
| 5,460,353 | 10/1995 | Rittenhouse | 256/64 |

FOREIGN PATENT DOCUMENTS

| | | | |
|---|---|---|---|
| 2048517 | 3/1971 | France | 119/705 |
| 2388578 | 11/1978 | France | 119/705 |
| 2639843 | 6/1990 | France | 472/86 |
| 2152822 | 8/1985 | United Kingdom | 482/17 |
| 89/04196 | 5/1989 | WIPO | 119/705 |

*Primary Examiner*—Richard J. Apley
*Assistant Examiner*—Victor K. Hwang
*Attorney, Agent, or Firm*—Duane, Morris & Heckscher LLP

[57] ABSTRACT

An equestrian jumping device using telescopic standards which adjust the height of the jump. The jump height is determined by placing an elongated cup having a pin into predetermined holes positioned on the telescopic posts. The elongated cup and adjustable posts enable one to create a corner obstacle comprising of two poles and three standards. The two poles meet at one end in the elongated cup and then proceed in opposite directions to form a triangle or corner. The advantage of the adjustable standard eliminates the standard from protruding above the pole which could injure either horse or rider.

13 Claims, 5 Drawing Sheets

EQUESTRIAN JUMP AND BRACKET FOR CREATING AN ANGULAR OBSTACLE

FIELD OF THE INVENTION

This invention generally relates to portable obstacles, and particularly to portable obstacles used in the training for equestrian sports.

BACKGROUND OF THE INVENTION

Fences that are used in various sports, such as equestrian sports, consist generally of one or more horizontally extending poles that are supported at each end by vertically extending standards. The pole or poles may be supported by, for example, rigid posts or by empty barrels. Such poles must be supported in such a manner that a light contact will not necessarily displace the bar from the support. In order not to injure the horse or rider, a firm contact should displace the bar. If the support should be too rigidly held, the contact of the horse might result in severe injury to horse and rider.

Equestrian practice jumps are typically created out of wood or plastic such as polyvinyl chloride (PVC). These jumps consist of a solid base and a post or "upright" that extends upwardly from the base. A rail is sandwiched horizontally between two height standards and affixed to jump cups attached to the standards. Typically, the upright portion of the jumping standard is a predetermined height.

Portable obstacles are well known in the art. For example, U.S. Pat. Nos. 3,514,062, issued to Gordon in May, 1970; 4,239,168, issued to Colonna des Princes in December, 1980; 4,368,875, issued to Weiss et al. in January, 1983; 4,793,288, issued to Hoadley in December, 1988; 4,946,139, issued to Tomellini in August, 1990; and 4,989,821, issued to Wong in February, 1991, all disclose various portable obstacles and components associated with their construction and use.

Recent equestrian competitions have asked riders to negotiate "corner" obstacles. When viewed from above, a corner obstacle, is arranged in the shape of an open triangle. In cross-country competitions the preferred construction is that of very heavy solid materials, i.e., railroad ties or telephone poles. Consequently, the obstacle (e.g., a railroad tie) will not be displaced if the horse makes contact with it. Therefore, in order to prepare a horse to jump these solid obstacles in competition, it is necessary to construct practice obstacles that can be displaced when contacted by the horse.

In U.S. Pat. No. 4,368,875 to Weiss et al., metal and wood components with pin locking mechanisms to adjust jump heights are taught. Weiss discloses predetermined height standards with vertical holes in which jump cups are placed to raise and lower the height of the horizontal poles. However, Weiss et al. do not provide suitable structure to create a corner with two poles meeting in the same cup, and without the standard extending above the poles.

U.S. Pat. No. 4,989,821 to Wong teaches an alternative method wherein the standard remains at a predetermined height, but with the cup adjustable for various heights. Wong teaches that two poles may be used between the same two standards. However, Wong's two poles cannot create a corner since they cannot rest in the same cup. Rather, two poles may be used which are parallel to each other or one above the other.

U.S. Pat. No. 4,793,288 to Hoadley makes use of PVC in the construction of its obstacle. However, Hoadley's obstacle is designed for dog agility competitions, and does not teach connecting poles in a triangle formation to create a corner. Hoadley's structure appears to be limited to a high jump formed from vinyl siding and adapted for canine competition. The high jump has a straight vertical face and is not suitable to create the angle necessary for an equestrian corner obstacle.

U.S. Pat. No. 4,946,139 to Tomellini teaches the use of PVC for the construction of equestrian fences. Tomellini's standards, however, are not adjustable. Additionally, it would be impossible to create a corner obstacle with this design, without having the standard above the height of the pole. This results in a potential hazard if the horse were to contact the standard while attempting to jump the edge of the corner.

U.S. Pat. No. 3,514,062 to Gordon describes a conventional jump cup. Gordon's design has proven very useful and is widely used in all fields of the equestrian sports. However, Gordon fails to take into consideration the need for construction of corner jumps. A corner jump requires a cup capable of holding two poles. Gordon's jump cup is designed specifically to hold one pole.

Consequently, there exists an unsatisfied need for a movable corner obstacle that is made of lightweight, durable, and weatherproof materials.

SUMMARY OF THE INVENTION

The present invention provides a device for use in supporting a plurality of horizontally arranged poles for an equestrian fence. The invention is unique in that a cup is provided to hold two poles rather than one. The cup is specifically designed to fit onto and secure a vertically telescopic standard. This allows for adjustment of fence height with the compression and expansion of the standard.

In one preferred embodiment of the invention, an obstacle for use in equestrian jumping is provided comprising at least three vertical members positioned so as to form a substantially triangular array. At least two horizontal members are provided, each having two ends, and each extending from one of the outlying vertical members to a central vertical member. Advantageously, supports are movably fastened to a portion of each vertical member, and include a width sufficient to receive an end of each horizontal member adjacent one another, at the same elevation, and without having a substantial portion of the vertical members extending above the support.

BRIEF DESCRIPTION OF THE DRAWINGS

In order that the invention may be clearly understood, it will now be described, by way of example, with reference to the accompanying drawings, wherein like numerals refer to like parts and further wherein.

DETAILED DESCRIPTION OF THE PREFERRED EMBODIMENT

Figure 1:
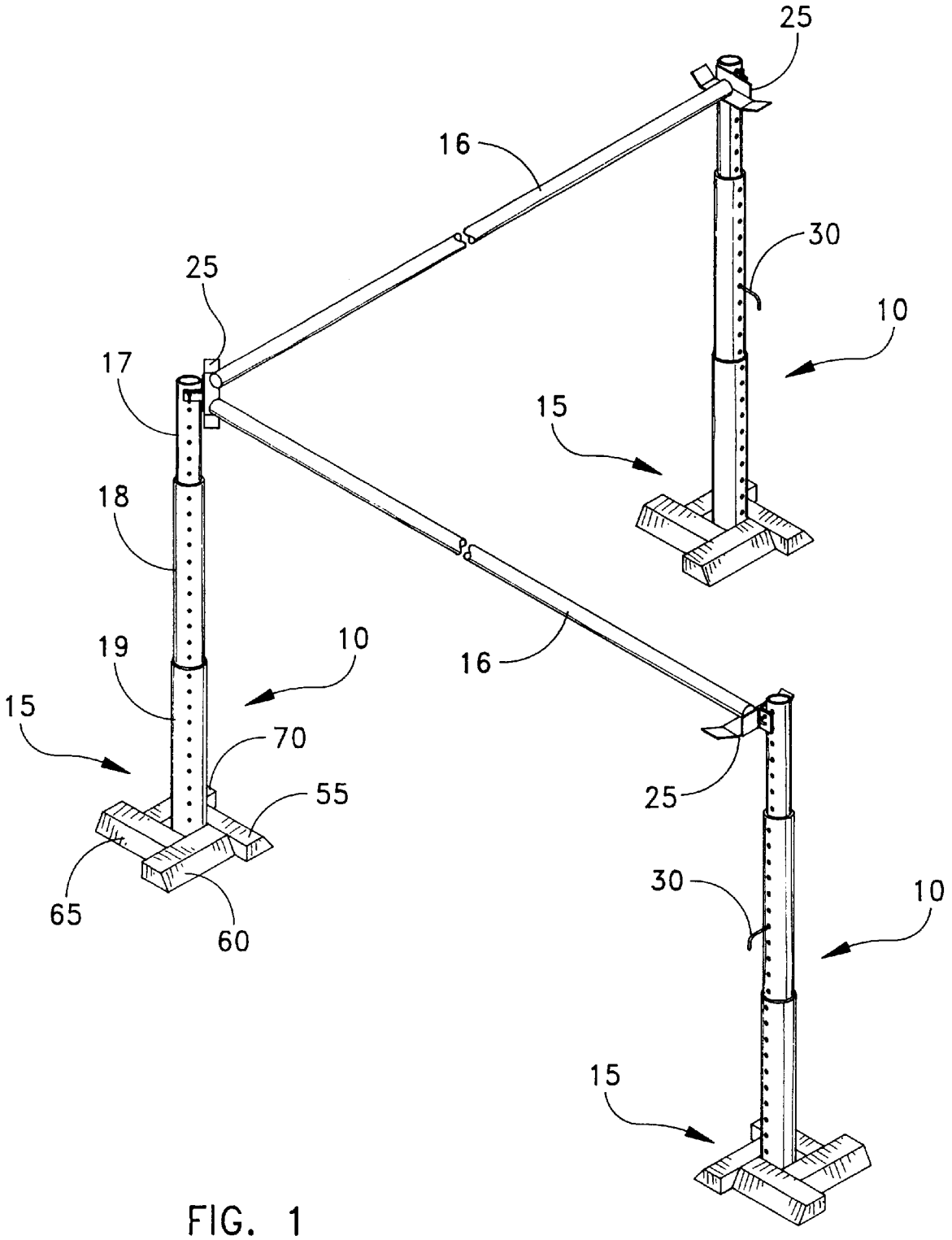
FIG. 1 is a perspective view of a "Corner" obstacle for equestrian jumping formed in accordance with the present invention.

Referring to FIG. 1, corner obstacle 5 is shown comprising three telescopic standards 10, three corresponding bases 15, at least two poles 16, and three jump cups 25. More particularly, and now referring to FIG. 2, telescopic standards 10 may be constructed from a polymer material, such as polyvinyl chloride (PVC) or the like, light weight metal, or other solid material, and may be either round or square in shape. Each standard 10 is preferably constructed out of two or more different sized tubes 17, 18, and 19. Each tube comprises a plurality of hole pairs 20 that are positioned along the length of each of tubes 17, 18, 19 in transverse relation to the longitudinal axis of each tube. Each hole, in a pair of holes, is disposed in confronting coaxially-aligned relation to its opposing hole.

Figure 2:
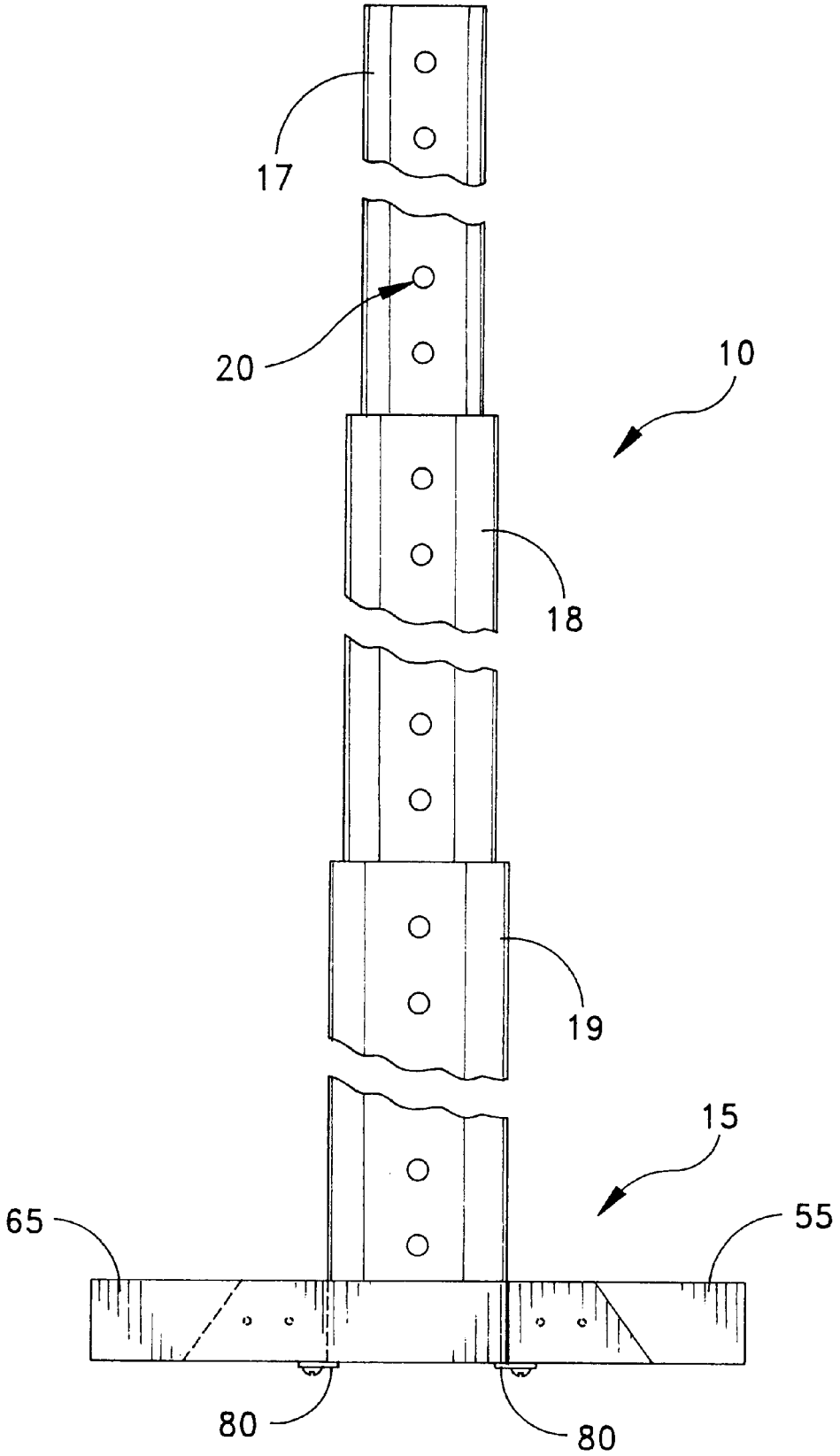
FIG. 2 is a side elevational view of a telescopic standard assembled to a base as shown in FIG. 1.

Preferably, tube 17 comprises the inner most and smallest tube of standard 10, having an inside diameter of about 1½ inches. Tube 18 comprises a middle sized tube having an inside diameter of about 2 inches and tube 19 comprises the outer most and largest tube having an inside diameter of about 2½ inches. As seen in FIGS. 1 and 2, tube 17 is coaxially disposed within a portion of tube 18, and the assembled tubes 17 and 18 are coaxially disposed within a portion of tube 19. Thus tubes 17,18, and 19 slide relative to one another, with tube 17 fitting inside tube 18, and tube 18 fitting inside of tube 19. When standard 10 is fully collapsed it preferably has a height of approximately 2 feet 6 inches. When standard 10 is fully extended, i.e., when tube 17 is fully extended from tube 18 and tube 18 is fully extended from tube 19, it has a preferred height of approximately 5 feet. The height of standard 10 is adjustable as disclosed hereinabove and may be fixed in height by inserting pins 30 through one of plurality of hole pairs 20 so as to prevent the relative sliding of tubes 18 and 19. The relative height of tube 17 may be adjusted either by application of a pin 30, or as a part of the assembly of cup 25, as will hereinafter be disclosed in further detail.

Figure 3:
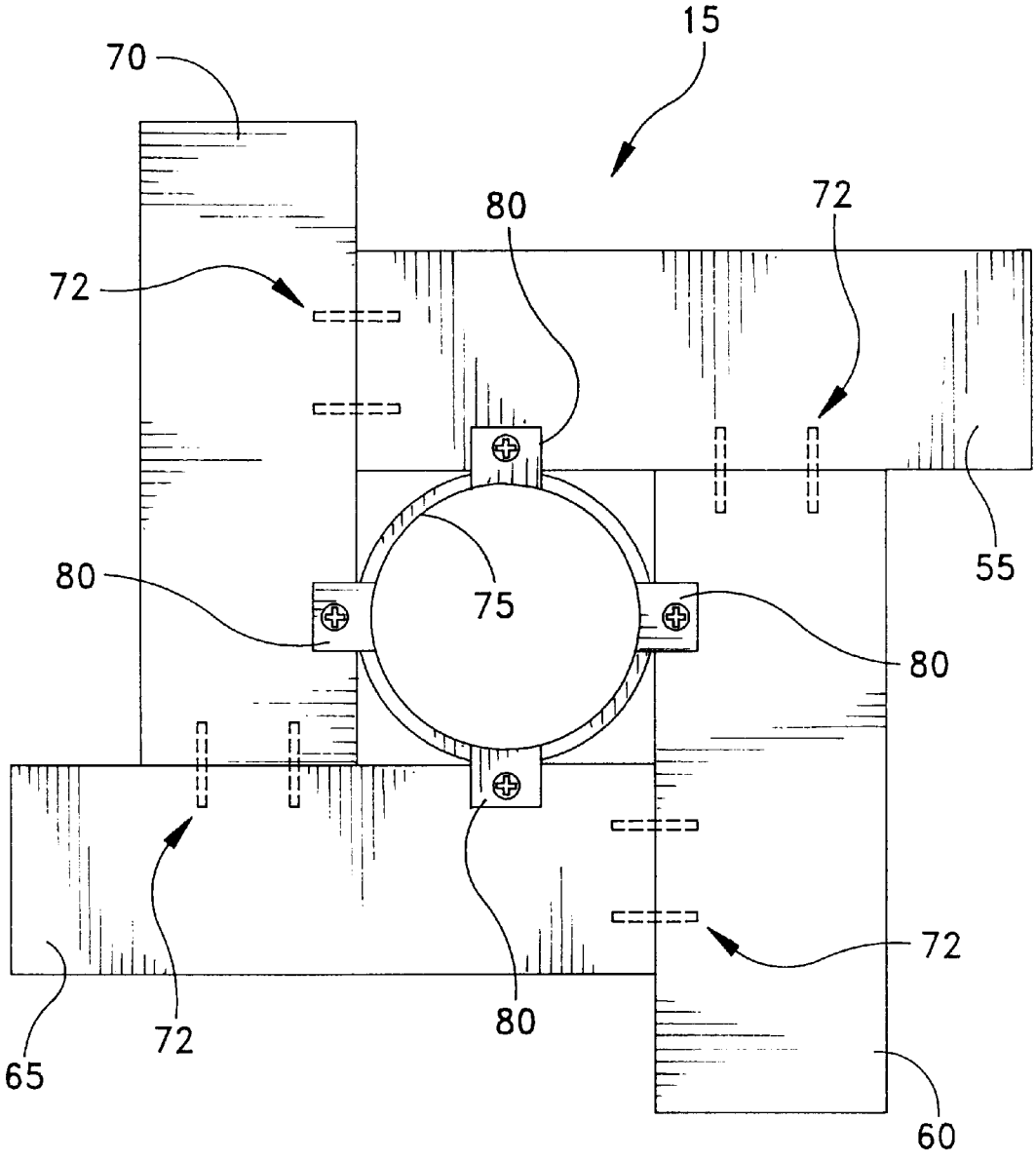
FIG. 3 is a bottom view of a base shown in FIG. 1, but with the standard removed for clarity of illustration.

Referring to FIGS. 1, 2 and 3, each base 15 provides support for a standard 10, and is preferably made of wood. Each base 15 typically comprises four members 55,60,65, 70. Members 55,60,65,70 are used to create a frame structure having a middle opening adapted for receiving a free end of tube 19 (FIG. 2). As shown in FIG. 3, members 55,60,65,70 are circumferentially arranged about a central cylinder 75, in mutually perpendicular relation to adjacent ones of the members. Members 55,60,65,70 are each fastened along an overlapping edge with two adjacent members by fastening means 72, e.g., screws, nails, staples, or glue. Cylinder 75 is preferably formed from a rigid material, such as plastic or metal, and comprises a diameter sized so as to accept bottom most tube 19 of standard 10. Cylinder 75 includes four clasps 80 that project outwardly from the bottom outer perimeter of cylinder 75 in substantially perpendicular relation. Clasps 80 each include a centrally disposed bore adapted to receive a fastener for fastening members 55,60,65,70 to cylinder 75.

Figure 4A:
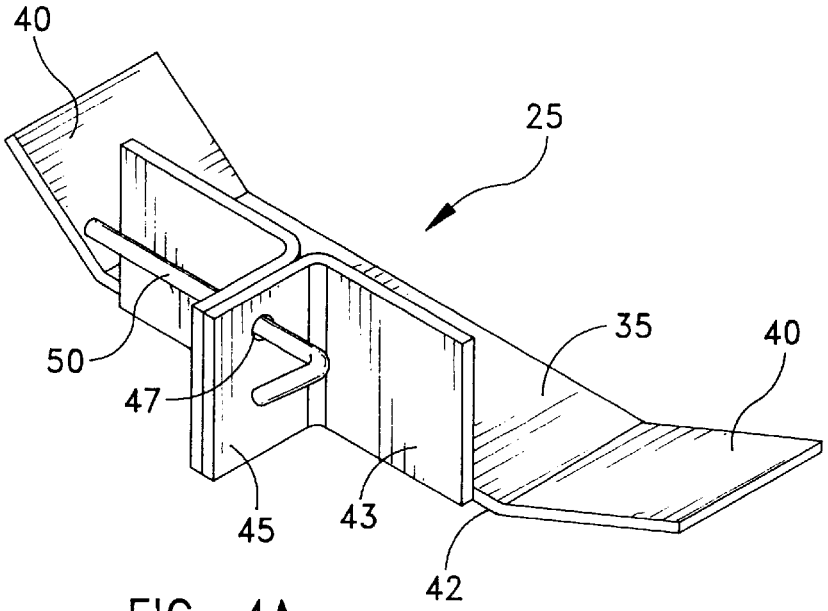
FIG. 4A is a rear perspective view of a jump cup formed in accordance with the present invention.
Figure 4B:
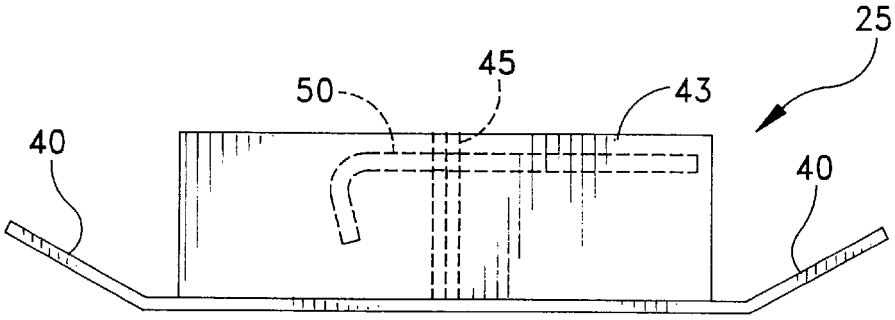
FIG. 4B is a front elevational view, partially in phantom, of the jump cup shown in FIG. 4A.
Figure 4C:
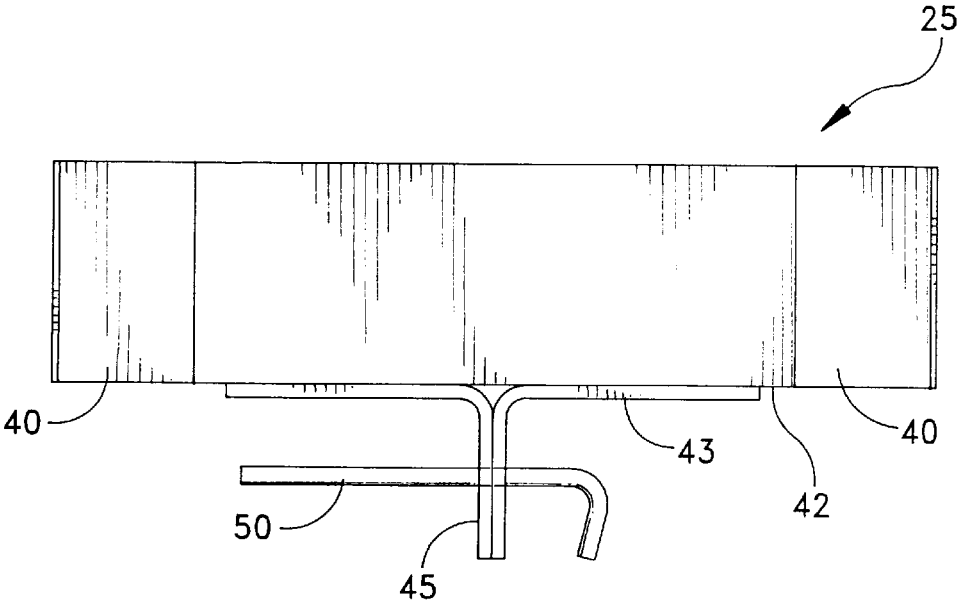
FIG. 4C is a top view of the jump cup shown in FIG. 4A.
Figure 5:
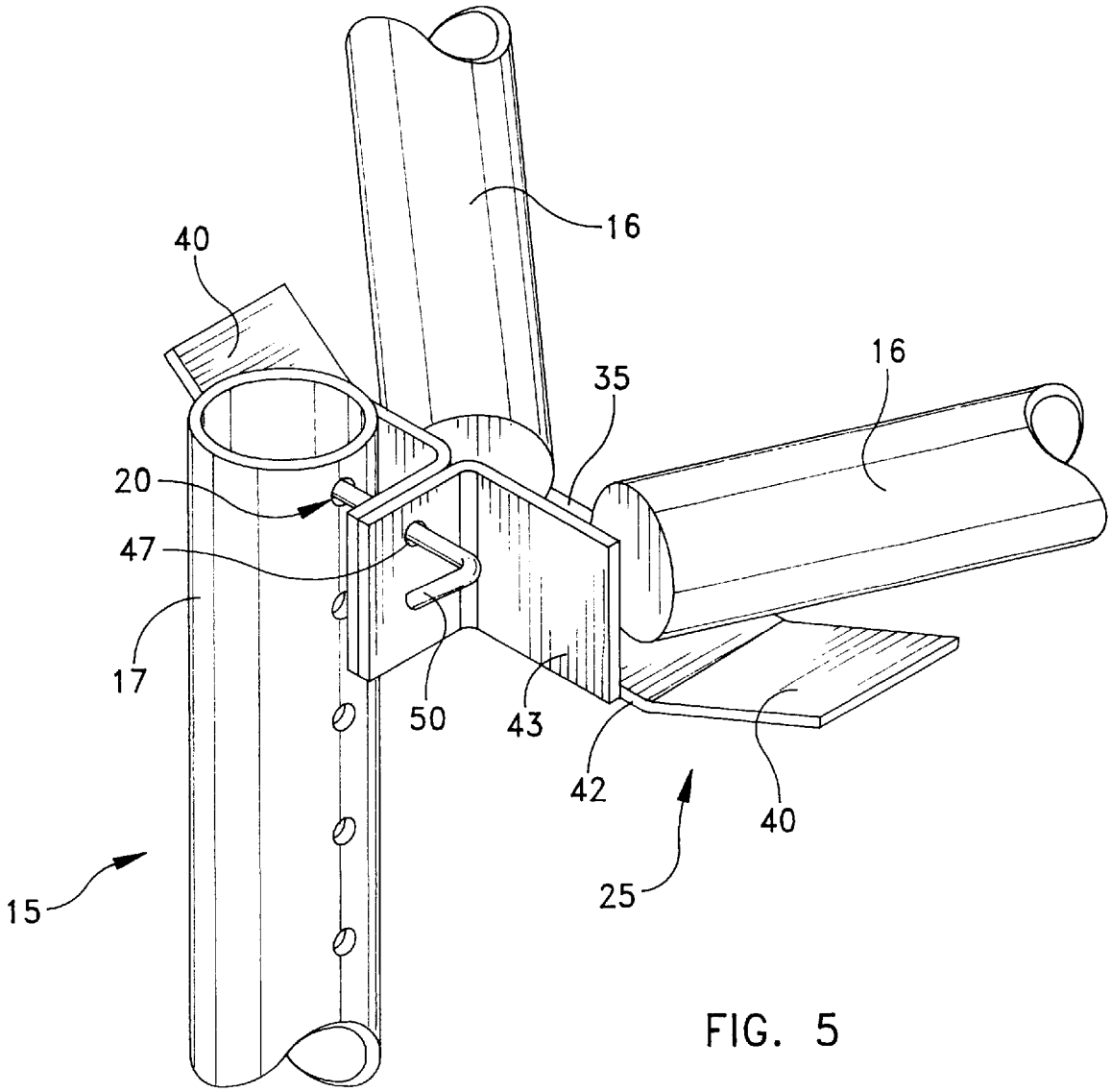
FIG. 5 is a rear perspective view of a portion of a standard and a jump cup as shown in FIG. 1, with the cup supporting two horizontal poles.

Referring to FIGS. 4A–4C, cup 25 comprises a supporting member including a flat plate 35, wings 40, a rear edge 42 and a support plate 43. More particularly, wings 40 project upwardly from the left and right side edges of flat plate 35 at approximately a 25° to 60° angle. Support plate 43 projects upwardly from rear edge 42 in substantially perpendicular relation to flat plate 35. The length of cup 25 is preferably about 9 inches. Of course, it will be understood that cup 25 may be formed in various lengths with preferred lengths being between about 4½ inches and about 9 inches. Advantageously, the length of flat plate 35 allows for two poles 16 to be supported by cup 25 so that a corner obstacle 5 may be formed (FIGS. 1 and 5). An arm 45 projects outwardly from the rear side of support plate 43, and is disposed in perpendicular relation to support plate 43. A bore 47 is formed in arm 45, and is sized so as to receive a pin 50. When positioned in bore 47, pin 50 is disposed in parallel relation to flat plate 35 of cup 25. Pin 50 is sized and shaped so as to be received in one of the plurality of pairs of holes 20 of tube 17 (FIGS. 1 and 5).

Corner obstacle 5 is assembled by first placing each standard 10 into a corresponding support cylinder 75 of a base 15. More particularly, tube 19, of each standard 10, is oriented so as to be disposed in confronting coaxial relation to cylinder 75. Telescopic standard 10 is then moved toward cylinder 75 until tube 19 enters and is snugly received by cylinder 75. Tubes 17 and 18 are then slid, relative to tube 19 and each other, until standard 10 is adjusted to the required height. Pins 30 are then slid into appropriate holes 20 in each standard 10 so as to prevent the relative sliding movement of tubes 18 and 19, and to fix standard 10 at the required height. Pin 50 is used to set the height of tube 17 relative to tubes 18 and 19.

Next, a jump cup 25 is assembled to each telescopic standard 10 adjacent to the top most portion of tube 17. More particularly, rear edge 42 of each flat plate 35 is positioned so that support plate 43 engages tube 17 adjacent its free end, and arm 45 engages a side of tube 17 so that bore 47 is disposed in coaxial alignment with one of the pairs of holes 20. Once in this position, pin 50 is slid through bore 47 and a pair of holes 20 so as to fasten cup 25 to tube 17. As a result of this construction, support plate 43, arm 45 and pin 50 maintain the longitudinal axis of cup 25 horizontal, i.e., cup 25 will be positioned substantially perpendicular to tubes 17,18,19 (FIGS. 1 and 5).

It will be appreciated that the vertical location of cup 25 is adjustable by merely removing pins 30 and sliding tubes 17,18, and 19 relative to one another and then reinserting pins 30. One advantage of the present invention is that cup 25 may be assembled to standard 10 so that no portion of standard 10 extends upwardly beyond cup 25. This is substantially different from those standards with predetermined height such as are disclosed in U.S. Pat. Nos. 4,368,875; 4,793,288; 4,989,821; 4,946,139. The advantage of the present construction is that when creating a corner obstacle, the standard is never higher than the pole. When the standard is higher than the pole, as with the above-identified patents, a risk of injury arises for both horse and rider. The present invention avoids this problem in the prior art.

Not only does cup 25 support poles 16, but also, pin 50 may be used to further set or adjust the height of the standard, i.e., by allowing further fine adjustment of the extent to which tube 17 extends out of tube 18. This feature of the present invention is significantly different than that taught in U.S. Pat. No. 3,514,062, which discloses two arms extending backward from the cup. The present invention has only one arm extending backward from cup 25. Furthermore, U.S. Pat. No. 3,514,062 discloses and depends upon a removable pin to set the height of the cup. Although U.S. Pat. No. 4,239,168 also uses a permanently attached pin, that pin attaches to the front of the standard. Furthermore, no prior art discloses a cup large enough to hold two poles. The cup of the present invention is made much longer than any other support to support two poles at the same time so as to create corner obstacle 5.

Once each standard 10 is fully assembled to a base 15 and comprises a cup 25, poles 16 may be disposed between each standard, as shown in FIG. 1. Poles 16 (FIGS. 1 and 5) comprise elongate, light weight shafts of the type well known in the art for use in the preparation of fence-type obstacles. Poles 16 are typically 9 feet or more in length.

Advantageously, a corner obstacle can be created using three (3) standards and two (2) or more poles 16. A central standard supports two poles while two standards are set apart from the central standard thereby creating a triangle. The angle formed at the central standard by the two poles will determine the degree of difficulty of the jump. Again, the standard does not extend above the height of the poles. This safety feature is not found in the prior art.

To form corner obstacle 5, three standards 10 are first arranged in a substantially triangular pattern. An end of each pole 16 is positioned on flat plate 35 of cup 25 that has been assembled to the central standard 10 of the triangle (FIG. 1). The other ends of each pole 16 are positioned on the respective flat plates 35 of cups 25 assembled to the other two outlying standards 10 that make up corner obstacle 5. It should be understood that the length of cup 25 allows for the placement of poles 16 in obstacle 5 at varying relative included angles, from about 150° to about 30° more or less. It will be appreciated that wings 40 will help to maintain poles 16 in position when a jumper merely brushes a pole during a jump. However, with sufficient impact upon pole 16, pole 16 will slip over wing 40 and obstacle 5 will be breached.

The present invention may be practiced with many modifications, changes and variations without departing from its scope or spirit as defined in the appended claims. For example, the jump may also be used to make "skinny" fences rather than "Corner" jumps. This is done by using two telescopic standards 10, with short poles (i.e., 4½' as opposed to 9'). As disclosed hereinabove, a benefit of the invention is the prevention of the standard extending beyond the height of the poles. This is both a safety feature, and a necessary competitive training technique. It is beneficial to practice these obstacles in a form that will dislodge when the horse contacts them before attempting to jump the solid competition fences that do not dislodge regardless of the extent of contact.

Furthermore, the height of standards 10 may vary considerably with various materials. Examples are provided of standards of 2'6" to 5', however, standard 10 could be made 1 foot to 8 feet, or more, if so desired. The jumps may also be personalized with different color schemes, or heights marked on the standard, or angles marked onto the cups.

Thus, the scope of the invention should be determined by the appended claims and their legal equivalents, rather than by the examples.

What is claimed is:

1. An obstacle for use in equestrian jumping comprising:

at least three vertical members positioned so as to form a substantially triangular array having a central vertical member and two outlying vertical members;

at least two horizontal members each having two ends and each extending from one of the outlying vertical members to said central vertical member; and a support movably fastened to a portion of said central vertical member, said support having a width sufficient to receive an end of each horizontal member adjacent one another, at the same elevation, and without having a substantial portion of said vertical members extending above said support wherein said support includes a flat plate having wings projecting upwardly from side edges thereof; a support plate projecting upwardly from a rear edge of said flat plate and in substantially perpendicular relation thereto, said support plate including an arm projecting outwardly therefrom and disposed in perpendicular relation to said support plate, said arm including a bore sized so as to receive a pin.

2. Apparatus according to claim 1 wherein said support is more than twice as wide as said central vertical member so that said support projects horizontally outwardly from said central vertical member.

3. Apparatus according to claim 1 wherein each vertical member comprises two or more different sized tubes disposed in telescoping relation to one another.

4. Apparatus according to claim 3 wherein each tube comprises a plurality of hole pairs and further wherein each hole in a pair of holes is disposed along the length of said tube.

5. Apparatus according to claim 1 wherein said vertical members comprise a first tube comprising a smallest inside diameter, a second tube comprising a mid-sized inside diameter, and a third tube comprising a largest inside diameter so that said first tube may be coaxially disposed within a portion of said second tube and the assembled first and second tubes may be coaxially disposed within a portion of said third tube whereby said first, second, and third tubes are adapted to slide relative to one another, with said first tube fitting inside said second tube and said second tube fitting inside said third tube.

6. Apparatus according to claim 5 wherein said vertical members comprise a minimum height of approximately 2 feet 6 inches when said first tube is substantially disposed within said second tube and said second tube is substantially disposed within said third tube.

7. Apparatus according to claim 5 wherein said vertical members comprise a maximum height of approximately 5 feet when said first tube is fully extended from said second tube and said second tube is fully extended from said third tube.

8. Apparatus according to claim 5 wherein said vertical members comprise an adjustable height wherein each said vertical member is fixed in height by inserting a pin through one of a plurality of hole pairs disposed in said tubes so as to prevent the relative sliding of said tubes.

9. Apparatus according to claim 1 wherein when said pin is positioned in said bore, said pin is disposed in parallel relation to said flat plate.

10. Apparatus according to claim 9 wherein said pin is sized and shaped so as to be received in one of a plurality of pairs of holes disposed in said vertical members.

11. Apparatus according to claim 10 wherein said support has a flat plate that comprises a length of between about 4½ inches and about 9 inches.

12. An obstacle for use in equestrian jumping comprising:

two vertical members positioned apart;

at least one horizontal member having two ends and extending from one of said vertical members to the other; and two supports, one movably fastened to a portion of each vertical member with no portion of said vertical members disposed higher than said supports wherein each of said two supports includes a flat plate having wings projecting upwardly from side edges thereof; a support plate projecting upwardly from a rear edge of said flat plate and in substantially perpendicular relation thereto, said support plate including an arm projecting outwardly therefrom and disposed in perpendicular relation to said support plate, said arm including a bore sized so as to receive a pin.

13. An obstacle for use in equestrian jumping comprising:

at least three vertical members positioned so as to form a substantially triangular array having a central vertical member and two outlying vertical members;

at least two horizontal members each having two ends and each extending from one of the outlying vertical members to said central vertical member; and a support movably fastened to a portion of each vertical member with no portion of said vertical members disposed higher than said support wherein said support includes a flat plate having wings protecting upwardly from side edges thereof; a support plate projecting upwardly from a rear edge of said flat plate and in substantially perpendicular relation thereto, said support plate including an arm projecting outwardly therefrom and disposed in perpendicular relation to said support plate, said arm including a bore sized so as to receive a pin.

* * * * *